United States Patent [19]

Yamauchi et al.

[11] Patent Number: 4,894,100

[45] Date of Patent: Jan. 16, 1990

[54] TI-NI-V SHAPE MEMORY ALLOY

[75] Inventors: Kiyoshi Yamauchi; Shoichi Sato; Hideo Takaara, all of Miyagi, Japan

[73] Assignee: Tokin Corporation, Miyagi, Japan

[21] Appl. No.: 142,672

[22] Filed: Jan. 7, 1988

[30] Foreign Application Priority Data

Jan. 8, 1987 [JP] Japan ..... 62-2089

[51] Int. Cl.[4] ..... C22C 19/00

[52] U.S. Cl. ..... 148/402; 148/421; 148/426; 420/417; 420/441

[58] Field of Search ..... 148/402, 426, 421; 420/441, 417

[56] References Cited

U.S. PATENT DOCUMENTS 4,505,767 3/1985 Quin ..... 148/402

*Primary Examiner*—R. Dean

*Attorney, Agent, or Firm*—Hopgood, Calimafde, Kalil, Blaustein & Judlowe

[57] ABSTRACT

A shape memory alloy consisting, by atomic ratio, of V 0.25–2.0% and the balance of Ni and Ti, an atomic ratio of Ni and Ti being 0.96–1.06. The shape memory alloy has a good workability and a reduced temperature difference between a martensitic transition start point and an austenitic transition finish point. When the atomic ration of Ni/Ti is 0.96–1.02, the martensitic transition start point is the room temperature or higher. When the atomic ratio of Ni/Ti is 1.02–1.06, the martensitic transition start point is the room temperature or lower. The shape memory alloy has a pseudo elasticity.

11 Claims, 6 Drawing Sheets

TI-NI-V SHAPE MEMORY ALLOY

BACKGROUND OF THE INVENTION (1) Field of the Invention

The present invention relates to a shape memory alloy, and in particular, to a shape memory alloy having a small temperature difference between the martensitic transition start point and the austenitic transition finish point.

(2) Description of the Prior Art

A typical one of the shape memory alloy is Ti-Ni alloy.

Buehler et al. published in Journal of Applied Physics, 34 (1963), 1467 (reference 1) that Ti-Ni alloy had a unique property which was referred to as, so called, "shape memory effect"(S.M.E.). That is, when cooled, the alloy can easily be deformed below a certain temperature, and thereafter, when heated, the alloy rapidly recovers the original shape above another certain temperature. Thus, the alloy memorizes the original shape.

It is known in the art that the S.M.E. is based on a reverse transition of the martensitic transition which is referred to as the austenitic transition. Cooling the alloy accompanies a phase transition from the austenite to the martensite. The phase transition is called the martensitic transition. The martensitic transition starts from a certain temperature of Ms and finishes at another lower temperature of Mf. Thereafter, when the alloy is heated, the austenitic transition occurs. The austenitic transition starts at a temperature of As and finishes at another temperature of Af. Accordingly, the alloy has a thermal hysteresis in phase transition due to temperature variation.

Ms and Af can be controlled by adjusting an amount ratio of Ni/Ti and also by heat treating the alloy after being cold worked.

Further, the phase transition points of the shape memory alloy, such as the martensitic start point Ms and the austenitic transition finish point Af, shift to the higher temperatures under a stress loaded condition in comparison with no stress loaded condition.

The martensitic transition start point Ms is lower than the austenitic transition finish point Af due to the thermal hysteresis. That is, there is a temperature difference between Ms and Af. The temperature difference will be referred to as a thermal differential hereinafter. The Ti-Ni shape memory alloy usually has the thermal differential of several tens degree in the centigrade. The thermal differential can also be reduced by heat treating the alloy at about 400°-500 ° C. after cold working but it is still about 10°-20 ° C. which is not sufficiently small.

The Ti-Ni shape memory alloy has recently been used as a thermoresponsive element, for example, a thermoresponsive spring as an actuator. For example, the thermoresponsive spring of the shape memory alloy is expanded by a conventional bias spring and is connected to an object such as a louver to be actuated. When a circumferential temperature elevates above the austenitic transition finish point Af of the shape memory alloy, the thermoresponsive spring shrinks against the stress of the bias spring to recover the original shape and therefore, pulls and opens the louver. Thereafter, when the circumferential temperature lowers below the martensitic transition start point Ms, the thermoresponsive spring is again expanded by the bias spring so that the louver is closed. It is inconvenient that there is a large temperature difference between the louver opening temperature and the louver closing temperature.

Even if the actuator spring is heat treated after cold working, the thermal differential is still large, as described above.

Therefore, it is desirable for thermoresponsive elements that the shape memory alloy has a reduced and small thermal differential.

Further, it is also known that the shape memory alloy has pseudo elasticity or an elasticity based on the stress induced martensitic transition effect. That is, when a stress is applied to the shape memory alloy and is increased at a temperature higher than, but near, the austenitic finish point Af, the stress induced martensitic transition occurs. Thereafter, when the stress is released, the austenitic transition is caused without heating.

Accordingly, although the shape memory alloy is deformed by application of large stress, it recovers the original shape after removal of the stress. Therefore, the shape memory alloy also has some application fields where it is used as a pseudo elastic material. In a certain application field, it is desired that the shape memory alloy has the pseudo elasticity at the room temperature or lower, in particular, about 0 ° C.

A shape memory alloy is also known in the art which consists of Ti, Ni, and V, as disclosed in JP-A-53149732 (Tokukai sho 53-149732 which is corresponding to NL-A-7002632) (Reference 2), JP-A-60121247 (Tokukai sho 60-lb 121247 which is corresponding to U.S. patent application Ser. No. 541844) (Reference 3), and a paper entitled "Effect of Additives V, Cr, Mn, Zr on the Transition Temperature of TiNi Compound" by Honma et al in Bulletin of the Research Institute of Mineral Dressing and Metallurgy, Tohoku University, vol. 28, No. 2, Dec. 1972, pp. 209-219 (Reference 4).

Reference 2 discloses that an alloy represented by $Ti_{1-x}NiV_x$ ($0<x\leqq 0.21$) has a phase transition point between −200 ° C. and +20 ° C. In particular, a single actual example of $Ti_4Ni_5V$ is only disclosed to have the phase transition point between −200 ° C. and +20 ° C. An amount of V in the example is 10 at %.

Reference 3 discloses a shape memory alloy has the pseudo elasticity or the stress induced martensitic transition effect. In the shape memory alloy, atomic ratio of Ni/Ti is 1.07-1.11, and an amount of V is 5.25-15 at %.

According to our experiment, it is impossible to cold work the alloy containing a high amount of V such as 5 at % or more. It should be noted that samples are worked by casting and machining in references 2 and 3.

Reference 4 only discloses that addition of V into Ti-Ni alloy shifts the martensitic transition start point Ms of the alloy to a lower temperature.

Further, all of the References are silent as to the thermal differential of the alloy.

SUMMARY OF THE INVENTION

It is an object of the present invention to provide a shape memory alloy which has an excellent cold workability and a small thermal differential, that is, a temperature difference between the martensitic transition start point and the austenitic finish point.

It is another object of the present invention to provide a shape memory alloy which has the martensitic transition start point of the room temperature or higher as well as a reduced thermal differential.

It is still another object of the present invention to provide a shape memory alloy which has the martensitic transition start point of the room temperature or lower as well as a reduced thermal differential.

It is yet another object of the present invention to provide a shape memory alloy which has a pseudo elasticity at a temperature range below the room temperature.

According to the present invention, a shape memory alloy can be obtained which has an excellent workability and a reduced thermal differential or a reduced temperature difference between the martensitic transition start point and the austenitic transition finish point. The alloy consists of V 0.25–2.0 at % and the balance of Ti and Ni, an atomic ratio of Ni/Ti being 0.96–1.06.

In one aspect of the present invention, the atomic ratio of Ni/Ti is selected 0.96–1.02, and the alloy has the martensitic transition start point of the room temperature or higher.

In another aspect of the present invention, the atomic ratio of Ni/Ti is selected 1.02–1.06. In the case, the alloy has the martensitic transition start point of the room temperature or lower. The alloy is further characterized by a pseudo elasticity at the room temperature or lower.

The present invention will be described in connection with examples with reference to the accompanying drawings.

DESCRIPTION OF THE INVENTION

The present invention attempts to add a restricted amount of V of 0.25–2.0 at % into a Ti-Ni alloy having a restricted Ti/Ni atomic ratio of 0.96–1.06 so as to provide a novel shape memory alloy which has a reduced thermal differential as well as a high workability.

When a ratio of Ni/Ti is below 0.96 or when the ratio exceeds 1.06, workability of the alloy degrades considerably.

When the ratio of Ni/Ti is 0.96–1.02, the alloy has the martensitic transition start point of the room temperature or higher, that is, about 20°–70 ° C. The martensitic transition start point of the alloy is not affected by heat treating conditions such as temperature and time period. Therefore, the shape memory alloy having a desired martensitic transition start point can be readily produced. When the alloy is heat treated at a temperature of 425°–525 ° C. after being cold worked, the alloy has a thermal differential of about 5 ° C. under a stress loaded condition.

When the ratio of Ni/Ti is 1.02–1.06, the martensitic transition start point is the room temperature or lower, that is, about −150 to 20 ° C. When the alloy is heat treated at 425°–525 ° C. after being cold worked, the alloy has the martensitic transition point of about −10 ° C. to 20 ° C. under a stress loaded condition and has a reduced thermal differential of about 5 ° C. or less.

Advantage of V addition for the heat treating effect and the thermal differential is maximum at 0.5 at % and is not almost expected when an amount of V is below 0.25 at %. While, when V amount is increased from 0.5 at %, workability of the alloy tends to degrade although the advantage is almost maintained unchanged. Accordingly, an amount of V is restricted within a range of 0.5–2.0 at %, preferably 0.5–1.0 at %.

EXAMPLE 1

Alloy ingots containing ingredients shown in Table 1 were prepared by use of a high frequency induction vacuum furnace.

TABLE 1

| Alloy No. | Ingredients (at %) Ti | Ni | V | Cold Workability |
|---|---|---|---|---|
| 1 | 49 | 50.75 | 0.25 | Good |
| 2 | 49 | 50.50 | 0.50 | Good |
| 3 | 49 | 50.0 | 1.0 | Good |
| 4 | 49 | 48.5 | 2.5 | Impossible |
| 5 | 48.875 | 50.875 | 0.25 | Good |
| 6 | 48.75 | 50.75 | 0.50 | Good |
| 7 | 48.50 | 50.50 | 1.0 | Good |
| 8 | 47.75 | 49.75 | 2.5 | Impossible |
| 9 | 47.0 | 49.0 | 4.0 | Impossible |
| 10 | 46.5 | 48.5 | 5.0 | Impossible |
| 11 | 48.75 | 51.0 | 0.25 | Good |
| 12 | 48.50 | 51.0 | 0.50 | Difficult |
| 13 | 48.0 | 51.0 | 1.0 | Impossible |
| 14 | 46.5 | 51.0 | 2.5 | Impossible |
| 15 | 49 | 51 | — | Good |

Figure 1:
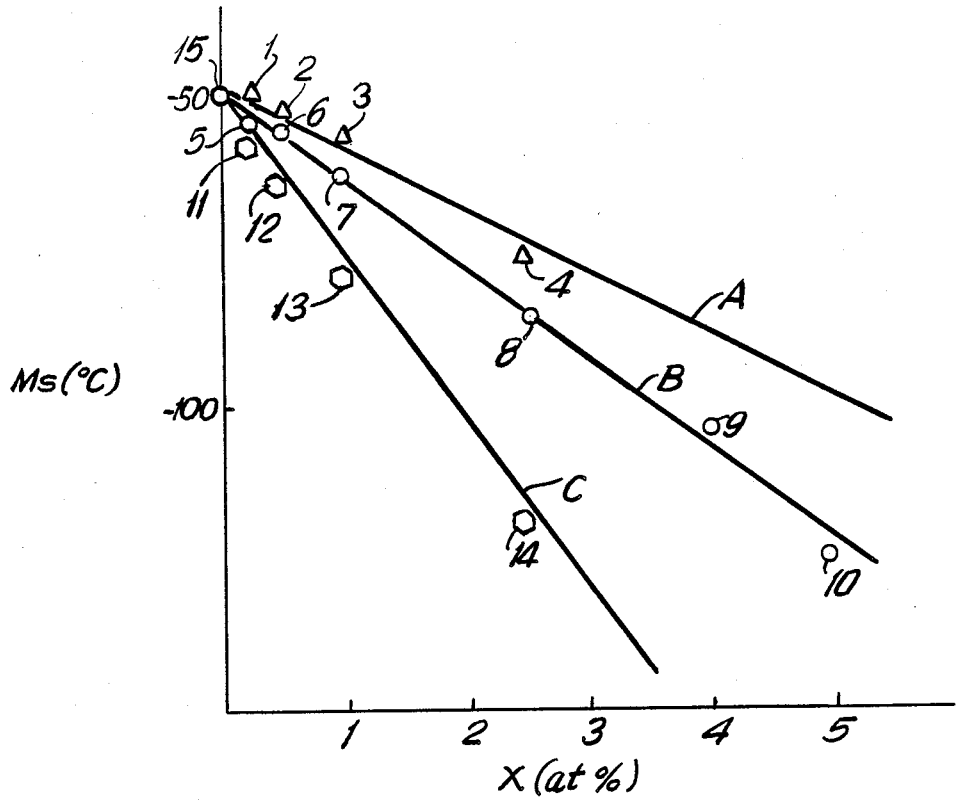
FIG. 1 shows a relationship between the martensitic transition start point and V content of alloy.

Alloy ingots of Nos. 1–15 were treated at 750 ° C. for one hour and their martensitic transition start points (Ms) were measured by use of a differential scanning calorimeter. The measured Ms are plotted with the alloy numbers in FIG. 1 in connection with V amount x. Nos. 1–4 alloys are represented by a formula of $Ti_{49}Ni_{51-x}V_x$ and are on a line A. Nos. 5–9 alloys are represented by another formula of $Ti_{49-x/2}Ni_{51-x/2}V_x$ and are on another line B. The other alloys Nos. 11–14 are represented by a formula of $Ti_{49-x}Ni_{51}V_x$ and are on a line C. FIG. 1 teaches us that addition of V shifts Ms to a lower temperature.

On the other hand, those prepared ingots were subjected to a solution heat treatment. Then, the treated ingots were worked into wires having a diameter of 1.3 mm, respectively, through hot hammering, hot rolling and cold wire drawing processes. Thereafter, the wires were further subjected through no annealing to another cold wire drawing to form sample wires having a diameter of 1.0 mm, respectively.

It was impossible to cold work Nos. 4, 8–10, 13, and 14 alloys, as described in Table 1. Accordingly, sample wires of these alloys were not obtained. Although No. 12 alloy was difficult in cold working, sample wires were obtained. Comparing Nos. 7, 12 and 13, it will be noted that Ti should be more than 48.0%, preferably, 48.5% or more.

The obtained sample wires of each alloy were heat treated for 30 minutes at different temperatures, that is, 400 ° C., 450 ° C., and 500 ° C., respectively. Tensil tests of the heat-treated sample wires were run at different temperatures within a temperature range from −20 ° C. to 50 ° C. The stress was increased to make a strain ($\epsilon$) of 5 % and then decreased to zero.

The measured stress-to-strain curves of sample wires of Nos. 6 and 15 are representatively demonstrated in FIGS. 2(*a*)–2(*f*) and FIGS. 3(*a*)–3(*f*), respectively. FIGS. 2(*a*), 2(*b*), 3(*a*), and 3(*b*) are for samples heat treated at 500 ° C. FIGS. 2(*c*), 2(*d*), 3(*c*), and 3(*d*) are for samples heat treated at 450 ° C. FIGS. 2(*e*), 2(*f*), 3(*e*), and 3(*f*) are for samples heat treated at 400 ° C. FIGS. 2(*a*), 2(*c*), 2(*e*), 3(*a*), 3(*c*), and 3(*e*) are for samples measured at 0 ° C. and FIGS. 2(*b*), 2(*d*), 2(*f*), 3(*b*), 3(*d*), and 3(*f*) are for samples measured at 20 ° C.

Sample wires of alloy No. 6 all exhibit an excellent pseudo elasticity at 20 ° C., and some of the sample wires which were heated at 400 ° C. and 450 ° C. has also an excellent pseudo elasticity even at 0 ° C. On the other hand, samples of No. 15 alloy containing no vanadium do not exhibit the pseudo elasticity at 0 ° C., at all, and a sample heated at 500 ° C. has no pseudo elasticity even at 20 ° C.

Figure 4:
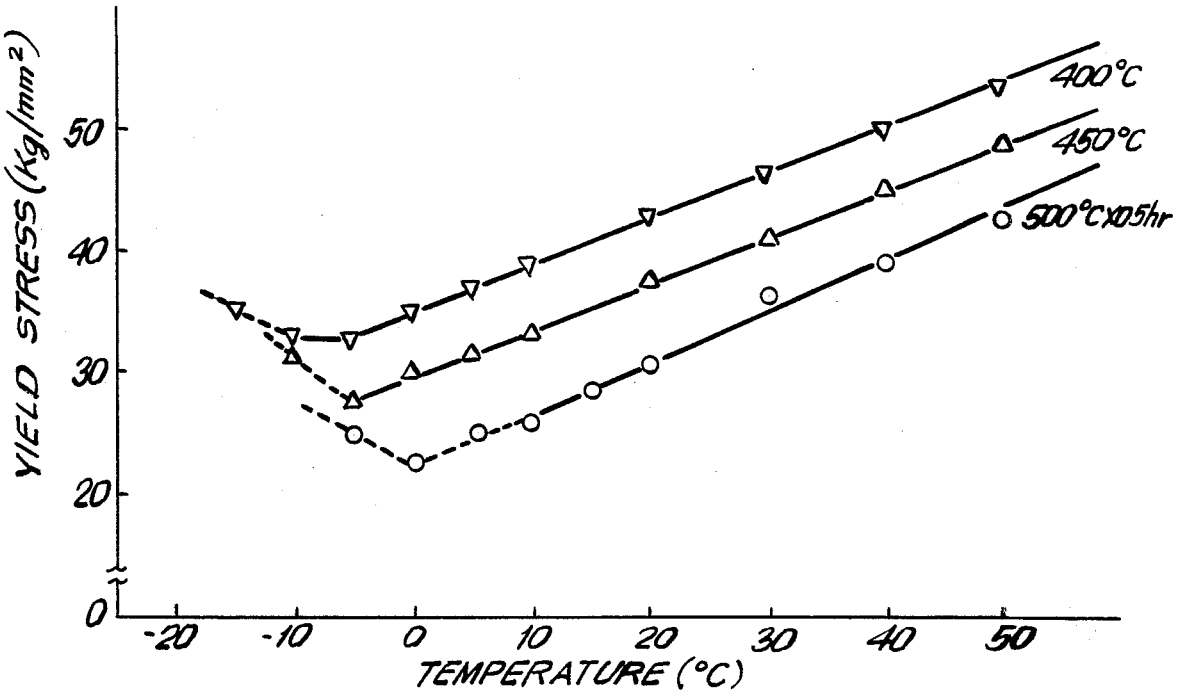
FIG. 4 shows yield stress to temperature curves of wire samples of alloy No. 6 heat treated at different temperatures.
Figure 2A:
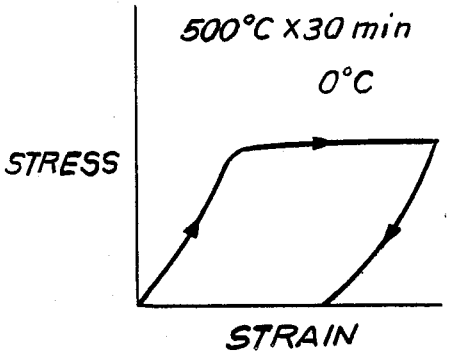
FIGS. 2(*a*) to 2(*f*) show stress to strain curves of sample wires of alloy No. 6 heat treated at different temperatures which were measured at different temperatures.
Figure 2B:
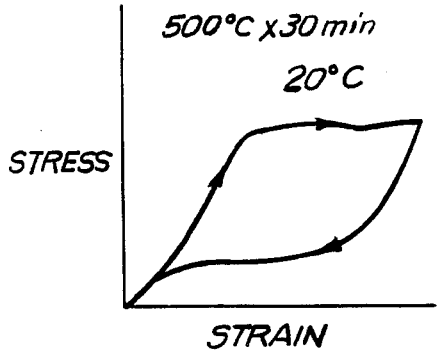
Figure 2C:
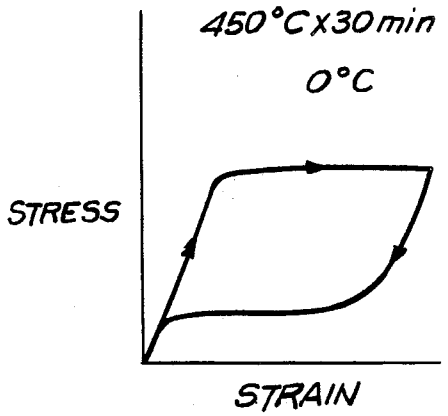
Figure 2D:
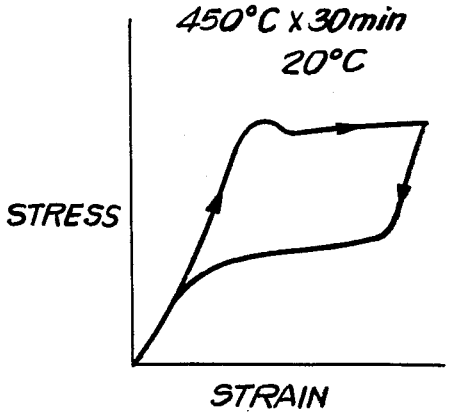
Figure 2E:
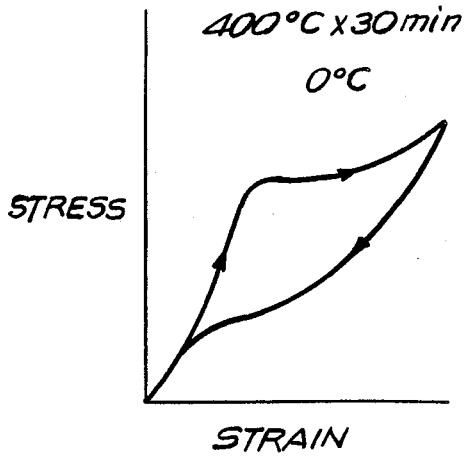
Figure 2F:
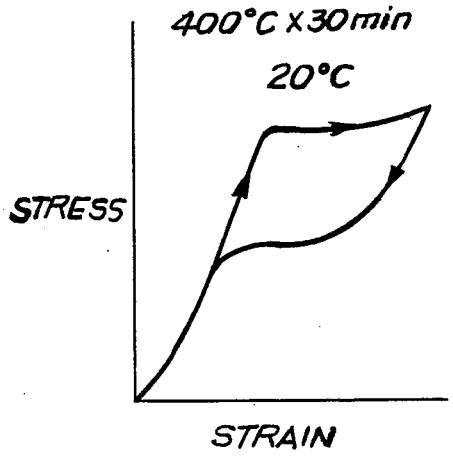
Figure 3A:
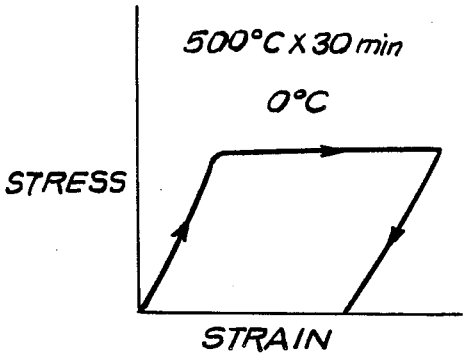
FIGS. 3(*a*) to 3(*f*) show stress to strain curves of sample wires of alloy No. 15 heat treated at different temperatures which were measured at different temperatures.
Figure 3B:
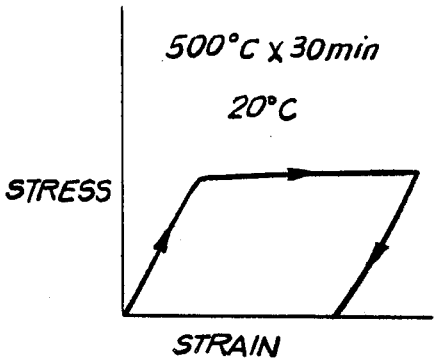
Figure 3C:
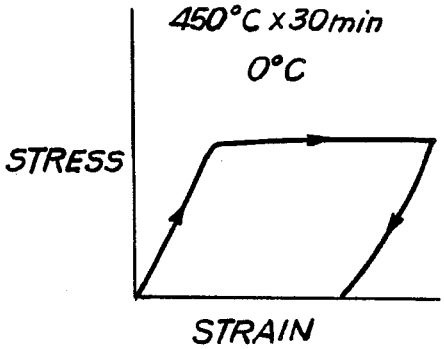
Figure 3D:
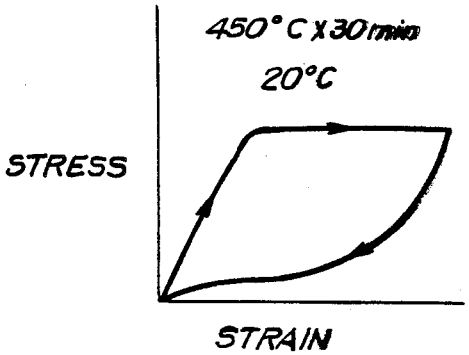
Figure 3E:
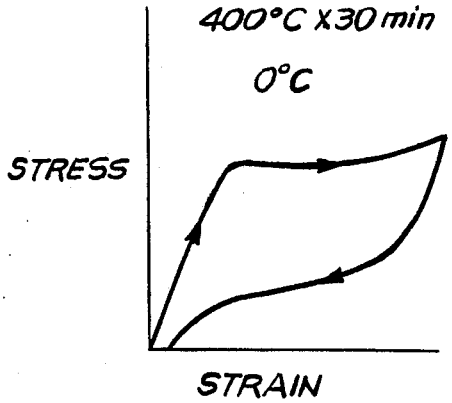
Figure 3F:
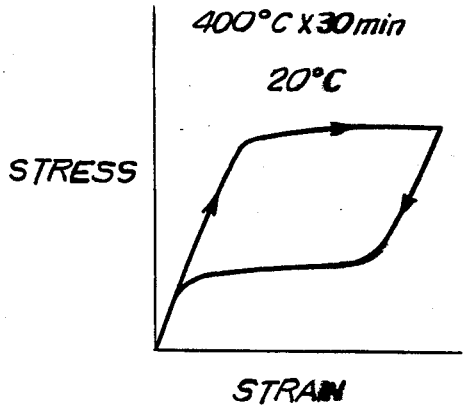

Further, yield stress was evaluated as to sample wires at different temperatures measuring the stress to strain curves similar to FIGS. 2(*a*) to 3(*f*). FIG. 4 demonstrates the evaluated yield stresses of samples of alloy No. 6 which were heated at 500 ° C., 450 ° C., and 400 ° C. as described above. In the figure, solid line portions show a region of the pseudo elasticity and broken line portions show a region of the shape memory effect. With regard to samples heated at 400 ° C. and 450 ° C., the pseudo elasticity presents at about −10 ° C. or higher.

Next, sample wires of each alloy having a diameter of 1 mm were wound by 30 turns around a rod having a diameter of 5 mm and heat treated for 30 minutes at 400 ° C., 450 ° C., and 500 ° C. to form coil springs. Coil springs having a diameter of 6 mm were obtained from samples heat treated at 450 ° C. and 500 ° C., but samples heat treated at 400 ° C. had an increased diameter of 8 mm due to the spring back. The similar result was also seen as to samples of alloy No. 15 which contained no vanadium.

Figure 5:
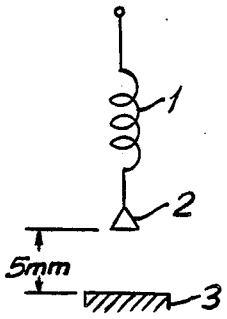
FIG. 5 shows a view for illustrating a manner for measuring extension of a coil spring made by a shape memory alloy in response to temperature variation under a stress loaded condition.
Figure 6:
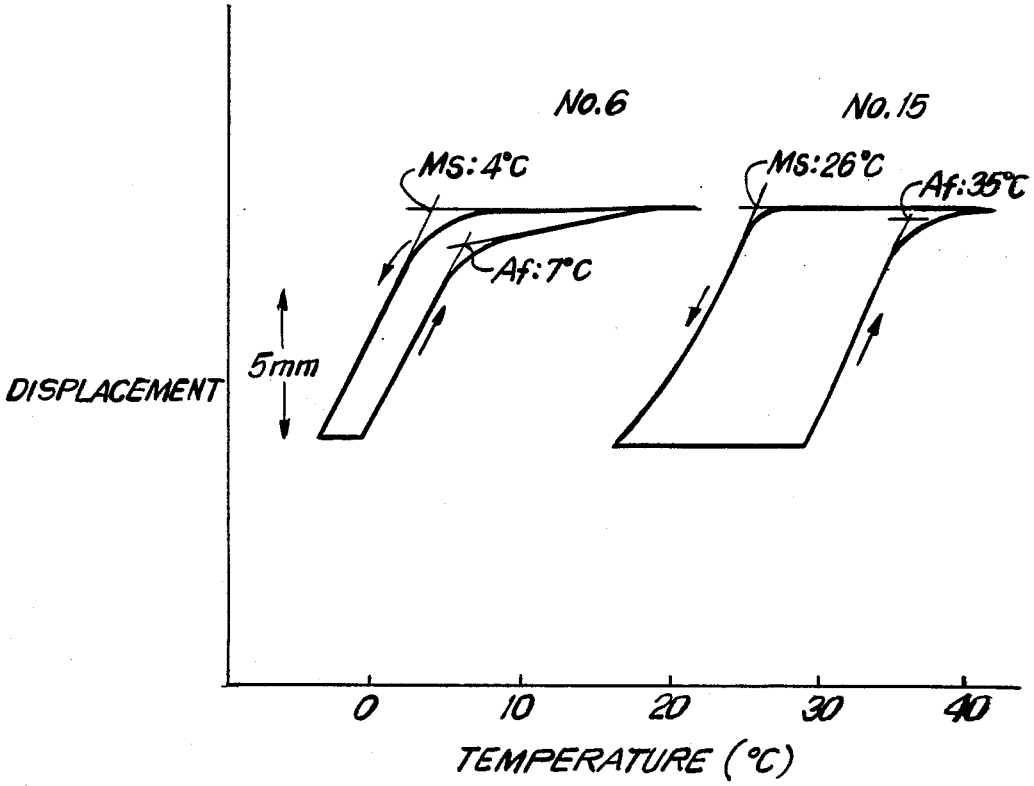
FIG. 6 shows extension to temperature responses of coil springs made of Nos. 6 and 15 alloys.

Extension of each coil spring in response to temperature variation was measured under a constant load applied to the coil spring. Referring to FIG. 5, a sample coil spring 1 was suspended and a weight 2 of 250 grams was attached to the lower end of the coil spring 1. A stopper 3 is disposed at 5 mm under the the weight 2. Then, the coil spring was cooled and heated and displacement of the weight 2 was observed. The martensitic transition start point Ms and the austenitic transition finish point Af were estimated from the measured relation between the displacement and the temperature. FIG. 6 shows displacement to temperature relations A and B of coil springs made of Nos. 6 and 15 alloys and heat treated at 500 ° C. From the relations A and B, Ms and Af of the alloys under a stress loaded condition were obtained as shown in the figure.

Ms and Af of other alloy samples in the stress loaded condition were measured in the similar manner. The measured Ms and Af are shown in Table 2.

TABLE 2

| Alloy No. | Af (°C.) | Ms (°C.) | Thermal Hysteresis (Af - Ms) (°C.) |
|---|---|---|---|
| 1 | 15 | 10 | 5 |
| 2 | 8 | 5 | 3 |
| 3 | 23 | 20 | 3 |
| 4 | — | — | — |
| 5 | 8 | 3 | 5 |
| 6 | 7 | 4 | 3 |
| 7 | 6 | 3 | 3 |
| 8 | — | — | — |
| 9 | — | — | — |
| 10 | — | — | — |
| 11 | 5 | 0 | 5 |
| 12 | 0 | −5 | 5 |
| 13 | — | — | — |
| 14 | — | — | — |
| 15 | 35 | 26 | 9 |

It is understood from Table 2 that alloys according to the present invention have small thermal differential, that is, a reduced temperature difference between Ms and Af which is about 5 ° C. or less.

EXAMPLE 2

In the similar manner as in Example 1, alloy ingots Nos. 16–27 in Table 3 were prepared and sample wires having a diameter of 1.0 mm were drawn.

TABLE 3

| Alloy No. | Ingredients (at %) Ti | Ni | V | Cold Workability |
|---|---|---|---|---|
| 16 | 50 | 50 | 0 | Good |
| 17 | 49.875 | 49.875 | 0.25 | Good |
| 18 | 49.75 | 49.75 | 0.5 | Good |
| 19 | 49.50 | 49.50 | 1.0 | Good |
| 20 | 48.75 | 48.75 | 2.5 | Difficult |
| 21 | 48.0 | 48.0 | 4.0 | Difficult |
| 22 | 47.5 | 47.5 | 5.0 | Impossible |
| 23 | 45.0 | 45.0 | 10.0 | Impossible |
| 24 | 50.75 | 48.75 | 0.5 | Good |
| 25 | 49.50 | 50.00 | 0.5 | Good |
| 26 | 49.25 | 50.25 | 0.5 | Good |
| 27 | 49.75 | 50.25 | — | Good |

It should be noted that alloys 17–19 are represented by the formula $Ti_{50-x/2}Ni_{50-x/2}V_x$ where x ranges from 0.5–2.0. Thus, in Example 17, the formula is $Ti_{50-0.25/2}Ni_{50-0.25/2}V_{0.25}$, or $Ti_{49.875}Ni_{49.875}V_{0.25}$, etc.

It was difficult to draw wires from Nos. 20 and 21 alloys in cold working and it was impossible to draw wires from Nos. 22 and 23 alloys in cold working.

The sample wires were worked into coil springs of 30 turns having a diameter of 6 mm in the similar manner as in Example 1.

Figure 7:
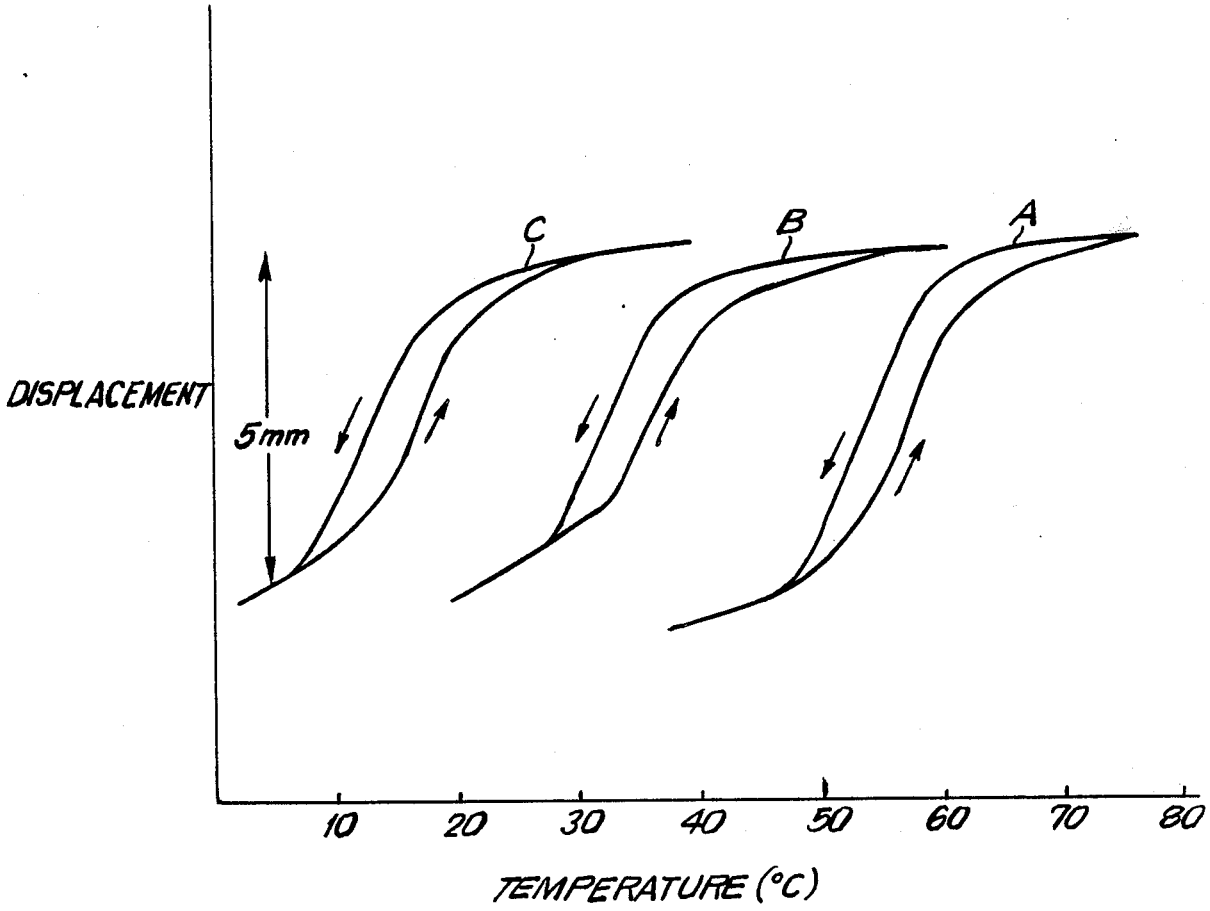
FIG. 7 shows extension to temperature responses of coil springs made of Nos. 18, 25, and 26 alloys.

Extension of each coil spring in response to temperature variation was measured in the manner as shown in FIG. 5 but using a weight 2 of 500 grams. FIG. 7 shows the measured displacement to temperature relations A, B, and C of Nos. 18, 25, and 26 alloy coil springs heat treated at 450 ° C. Ms and Af of those alloys in the stress loaded condition were evaluated from the obtained curves in the similar manner as shown in FIG. 6.

With respect to the other alloy samples, Ms and Af were measured in the similar fashion and are shown in Table 4.

TABLE 4

| Alloy No. | Af (°C.) | Ms (°C.) | Thermal Hysteresis (Af - Ms) (°C.) |
|---|---|---|---|
| 16 | 65 | 50 | 15 |
| 17 | 63 | 56 | 7 |
| 18 | 62 | 57 | 5 |
| 19 | 55 | 50 | 5 |
| 20 | 35 | 30 | 5 |
| 21 | 26 | 21 | 5 |
| 22 | — | — | — |
| 23 | — | — | — |
| 24 | 68 | 63 | 5 |
| 25 | 40 | 35 | 5 |
| 26 | 20 | 15 | 5 |
| 27 | 52 | 37 | 15 |

Table 4 teaches us that each of alloys according to the present invention has a reduced temperature difference between Ms and Af which is about 5 ° C.

Figure 8:
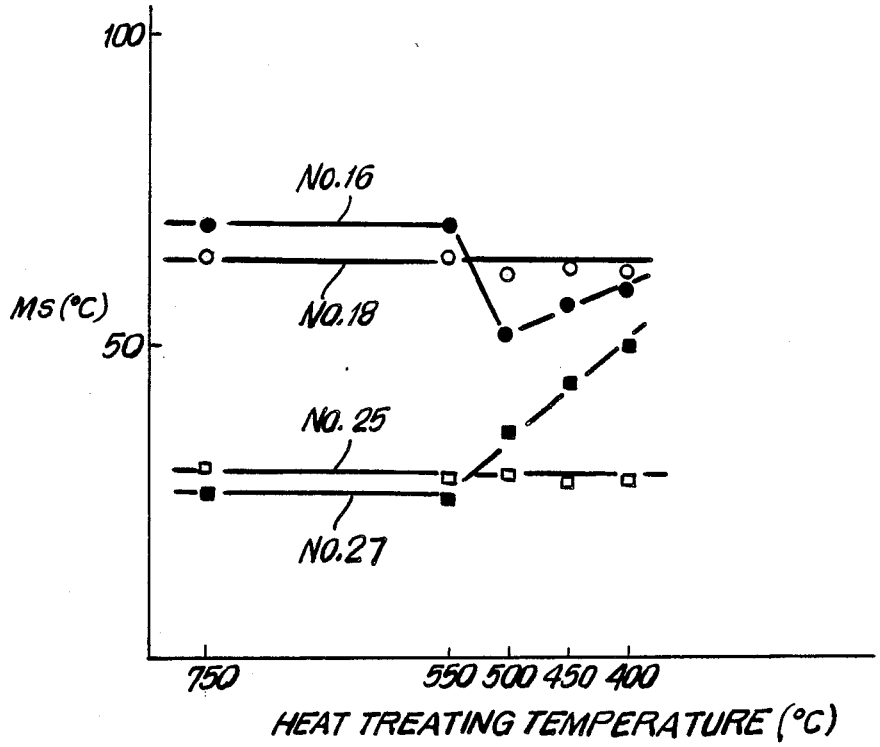
FIG. 8 shows a relationship between Ms and the heat treating temperature in connection with Nos. 16, 18, 25, and 27 alloys for a same heat treating time period of 30 minutes.
Figure 9:
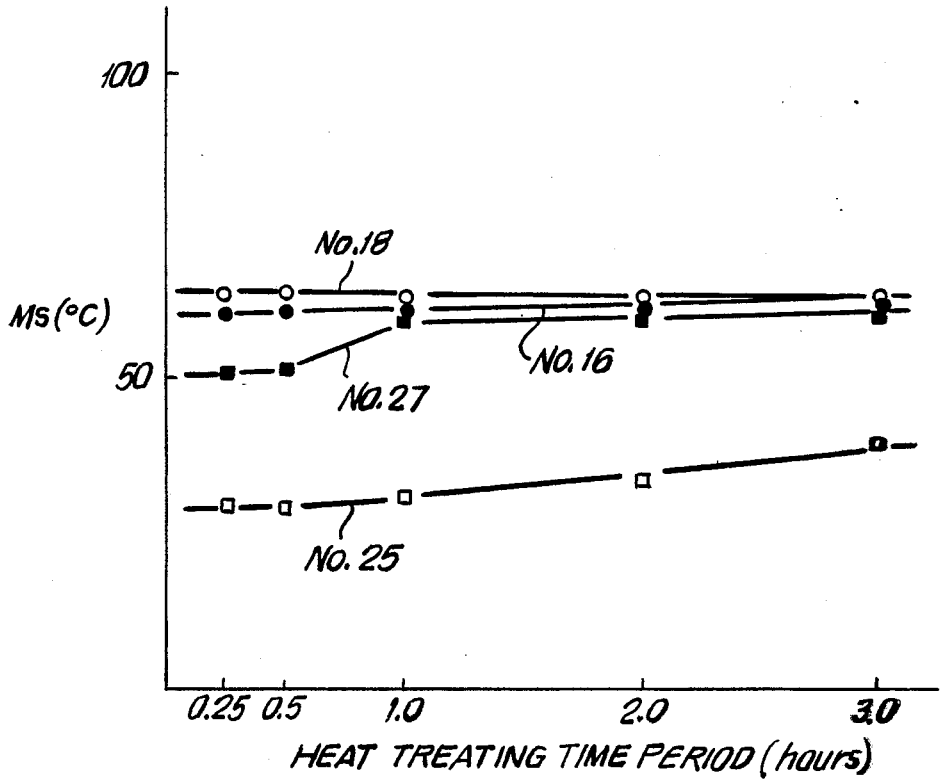
FIG. 9 shows a relationship between Ms and the heat treating time period in connection with Nos. 16, 18, 25, and 27 alloys at a same heat treating temperature of 400 ° C.

Next, each of the alloys in Table 3 was heat treated at different temperatures and for different time periods. The martensitic transition start point Ms of each of the heat treated alloys was examined by a differential scanning calorimeter. FIGS. 8 and 9 show a relation between Ms and the heat-treating temperature and a relation between Ms and the heat-treating time period, respectively, in connection with Nos. 16, 18, 25, and 27. The data shown in FIG. 8 were obtained when the heat-treating time period was 30 minutes, and the data shown in FIG. 9 were obtained when the heat-treating temperature was 400 ° C.

It is noted from FIGS. 8 and 9 that each of Nos. 18 and 25 alloys according to the present invention is not affected by heat treating temperature and time period and has a constant Ms. In comparison with this, Ti-Ni alloys of Nos. 16 and 27 are affected by the heat-treating temperature and time period.

This means that the shape memory alloys according to the present invention can be easily produced with an intended Ms.

What is claimed is:

1. A shape memory alloy having a good workability and a reduced temperature difference between a martensitic transition start point and an austenitic transition finish point, which consists of V 0.25–2.0 at %, Ti 48.5 at % or more, and the balance Ni, the atomic ratio of Ni/Ti being 0.96–1.06, said nickel excluding 50 at %.

2. A shape memory alloy as claimed in claim 1, wherein the atomic ratio of Ni/Ti is 0.96–1.02, and the martensitic transition start point is the room temperature or higher.

3. A shape memory alloy as claimed in claim 1, wherein the atomic ratio of Ni/Ti is 1.02–1.06, and the martensitic transition start point is the room temperature or lower.

4. A shape memory alloy as claimed in claim 3, which is characterized by a pseudo elasticity at the room temperature or lower.

5. A thermoresponsive article having a thermoresponsive point of a temperature higher than the room temperature, wherein said article is made of the shape memory alloy as claimed in claim 2, said article memorizing a predetermined shape present at a temperature range on and above said austenitic transition finish point, said predetermined shape being memorized by deforming said article, after formed by a cold working, into said predetermined shape and heat treating said article having the predetermined shape at a temperature of 425°–525 ° C. for 10–60 minutes.

6. A thermoresponsive article having a thermoresponsive point lower than the room temperature, wherein said article is made of the shape memory alloy as claimed in claim 3, said article memorizing a predetermined shape present at a temperature range on and above said austenitic transition finish point, said predetermined shape being memorized by deforming said article, after formed by a cold working, into said predetermined shape and heat treating said article having the predetermined shape at a temperature of 425°–525 ° C. for 10–60 minutes.

7. A shape memory alloy as claimed in claim 2, wherein said alloy is represented by $Ti_{50-x/2}Ni_{50-x/2}V_x$ ($0.25 \leqq x < 2.0$).

8. A shape memory alloy as claimed in claim 2, wherein said alloy is represented by $Ti_{50.75}Ni_{48.75}V_{0.5}$.

9. A shape memory alloy as claimed in claim 3, wherein said alloy is represented by $Ti_{49-x}Ni_{51}V_x$ ($0.25 \leqq x < 0.50$).

10. A shape memory alloy as claimed in claim 3, wherein said alloy is represented by $Ti_{49-x/2}Ni_{51-x}V_x$ ($0.25 \leqq x < 2.0$).

11. A shape memory alloy as claimed in claim 3, wherein said alloy is represented by $Ti_{49}Ni_{51-x}V_x$ ($0.25 \leqq x < 2.0$, excluding $x = 1$).

* * * * *